US010643567B2

(12) United States Patent
Kim

(10) Patent No.: US 10,643,567 B2
(45) Date of Patent: May 5, 2020

(54) SOURCE DRIVER AND DISPLAY APPARATUS INCLUDING THE SAME

(71) Applicant: DB HiTek Co., Ltd, Seoul (KR)

(72) Inventor: Yoo Sung Kim, Hanam-si (KR)

(73) Assignee: DB HiTek Co., Ltd., Seoul (KR)

( * ) Notice: Subject to any disclaimer, the term of this patent is extended or adjusted under 35 U.S.C. 154(b) by 0 days.

(21) Appl. No.: 16/233,693

(22) Filed: Dec. 27, 2018

(65) Prior Publication Data

US 2020/0035187 A1 Jan. 30, 2020

(51) Int. Cl.
*G09G 3/36* (2006.01)
*G09G 3/3275* (2016.01)

(52) U.S. Cl.
CPC ..... *G09G 3/3696* (2013.01); *G09G 3/3275* (2013.01); *G09G 3/3688* (2013.01); *G09G 2310/027* (2013.01); *G09G 2310/0289* (2013.01); *G09G 2310/0297* (2013.01); *G09G 2310/08* (2013.01); *G09G 2330/026* (2013.01); *G09G 2330/027* (2013.01)

(58) Field of Classification Search
CPC .. G09G 3/3233; G09G 3/3291; G09G 3/3614; G09G 3/3275; G09G 3/3283; G09G 2310/0251; G09G 2310/0297; G09G 2310/0248; G09G 2310/0291; G09G 2310/061; G09G 2310/0289; G09G 2310/0256; G09G 2300/0866; G09G 2300/0426; G09G 2300/0809; G09G 2330/025; G09G 2330/026; G09G 2330/027
See application file for complete search history.

(56) References Cited

U.S. PATENT DOCUMENTS

2002/0003521 A1* 1/2002 Matsueda ..... G09G 3/3688 345/89
2002/0196223 A1* 12/2002 Takahashi ..... G09G 3/367 345/90
2017/0287405 A1* 10/2017 Tseng ..... G09G 3/3225
2020/0020278 A1* 1/2020 Lee ..... G09G 3/3275

* cited by examiner

*Primary Examiner* — Dong Hui Liang
(74) *Attorney, Agent, or Firm* — Andrew D. Fortney; Central California IP Group, P.C.

(57) ABSTRACT

A source driver includes an amplification unit including a plurality of groups of amplifiers, each of the plurality of groups of amplifiers including a first amplifier and a second amplifier, multiplexers configured to select and provide an output of one of the first and second amplifiers in each of the plurality of groups to one of a plurality of data lines, charge share switch units corresponding to the multiplexers and between the plurality of data lines and a common line, and a control switch between the common line and a power supply configured to provide a reference voltage. Based on or in response to a power off reset (PFR) signal, the control switch provides the reference voltage to the common line, and the charge share switches connect the common line to the data lines, based on or in response to a power off rest (PFR) signal.

20 Claims, 4 Drawing Sheets

SOURCE DRIVER AND DISPLAY APPARATUS INCLUDING THE SAME

This application claims the benefit of Korean Patent Application No. 10-2018-0085825, filed on Jul. 24, 2018, which is hereby incorporated by reference as if fully set forth herein.

BACKGROUND OF THE INVENTION

Field of the Invention

Embodiments of the present invention relate to a source driver and a display apparatus including the same.

Discussion of the Related Art

A source driver may drive source lines of a display panel, and may include latches for storing data, level shifters for shifting the voltage level of the stored data, digital-to-analog converters for converting the level-shifted data into analog signals, a multiplexer, and an output unit for amplifying and outputting the analog signals to the source lines.

An image stabilization circuit of a display apparatus may enable the output of the source driver to have a ground voltage level in response to turning on or turning off a power supply, thereby stabilizing the image of the display apparatus.

In general, since an image stabilization switch is connected to an output, while turning off (e.g., performing a power off reset operation affecting) a power supply, the output from the output unit and a ground voltage for stabilization are instantaneously connected through a switch in a multiplexer in a plurality of channels or a plurality of data lines, thereby generating an overcurrent in the source driver chip.

SUMMARY OF THE INVENTION

Accordingly, embodiments of the present invention are directed to a source driver and a display apparatus including the same that substantially obviate one or more problems due to limitations and disadvantages of the related art.

An object of certain embodiments is to provide a source driver capable of preventing overcurrent at the time of a power off reset (PFR) operation and stabilizing an image of a panel when a power supply is turned on or off. Embodiments of the present invention also include a display apparatus including the source driver.

Additional advantages, objects, and features of the invention will be set forth in part in the description which follows and in part will become apparent to those skilled in the art upon examination of the following or may be learned from practice of the invention. The objectives and other advantages of the invention may be realized and attained by the structure(s) particularly pointed out in the written description and claims hereof, as well as the appended drawings.

To achieve these objects and other advantages and in accordance with the purpose(s) of the invention, as embodied and broadly described herein, the source driver includes (i) an amplification unit including a plurality of groups of amplifiers, each of the plurality of groups of amplifiers including a first amplifier and a second amplifier, (ii) multiplexers configured to select and provide an output of one of the first and second amplifiers in each of the plurality of groups to one of a plurality of data lines, (iii) charge share switch units corresponding to the multiplexers and between the plurality of data lines and a common line, and (iv) a control switch between the common line and a power supply configured to provide a reference voltage. The control switch may be turned on based on or in response to a power off reset (PFR) signal generated in response to turning off the power supply to provide the reference voltage to the common line, and the charge share switches are turned on based on or in response to the PFR signal.

When a voltage from the power supply to the amplification unit becomes less than a predetermined voltage, the PFR signal may have a first level, the control switch may be turned on by the PFR signal having the first level, the charge share switch units may be turned on by the PFR signal having the first level, and each of the multiplexers may be turned off by the PFR signal having the first level.

The multiplexers may be sequentially turned off with a predetermined time difference (e.g., between sequential multiplexers being turned off), and the charge share switch units may be sequentially turned on in synchronization with a turn-off time of a corresponding multiplexer.

Each of the charge share switch units may include first and second charge share switches respectively corresponding to the multiplexers (e.g., the first and second multiplexers), and each of the first and second charge share switches may be between a corresponding data line (e.g., connected to the corresponding multiplexer) and the common line.

When the multiplexers are sequentially turned off, each of the charge share switch units may be turned on (e.g., when a corresponding one of the multiplexers is turned off).

The first amplifier may have a driving voltage selected from an HVDD voltage and a VDD voltage. The VDD voltage may be greater than the HVDD voltage. A driving voltage from the second amplifier may be selected from a VSS voltage and the HVDD voltage, and the HVDD voltage may be greater than the VSS voltage.

The predetermined voltage may be greater than the VSS voltage and less than the HVDD voltage.

The reference voltage may be the HVDD voltage.

Each of the multiplexers may include a plurality of switches, and the switches of each of the multiplexers may selectively output data signals from the first and second amplifiers of a corresponding one of the plurality of groups of amplifiers to two neighboring or adjacent data lines of the plurality of data lines.

The switches of each of the multiplexers may be turned off by the PFR signal having the first level.

The control switch may be connected to a portion of the common line located between (i) a first node where the first charge share switch and the common line are connected and (ii) a second node where the second charge share switch and the common line are connected.

The control switch may include control switches corresponding to the multiplexers.

The source driver may further include a signal generator configured to sense a voltage level of the power supply and to generate the PFR signal having the first level when the sensed voltage level is less than the predetermined voltage.

According to one or more other embodiments, a source driver includes a plurality of amplifiers, multiplexers configured to select and provide an output of one of the amplifiers to one of a plurality of data lines, charge share switch units corresponding to the multiplexers and between the plurality of data lines and a common line, and a control switch between the common line and a power supply configured to provide a reference voltage. The amplifiers may be divided into a plurality of groups, and each of the plurality of groups includes a first amplifier and a second amplifier. Each of the multiplexers may selectively output data signals from the first and second amplifiers of a corresponding one of the plurality of groups of amplifiers to two neighboring or adjacent data lines of the plurality of data lines, and, when a voltage from the power supply to the amplifiers becomes less than a predetermined voltage, the control switch may be turned on, the multiplexers may be turned off, and the charge share switch units may be turned on.

The multiplexers may be sequentially turned off a predetermined time difference (e.g., between sequential multiplexers being turned off), and the charge share switch units may be sequentially turned on in synchronization with a turn-off time of a corresponding one of the multiplexers.

Each of the charge share switch units may include first and second charge share switches respectively corresponding to the multiplexers (e.g., the first and second multiplexers), and each of the first and second charge share switches may be between a corresponding data line (e.g., connected to the corresponding multiplexer) and the common line.

The first amplifier may have a driving voltage selected from an HVDD voltage and a VDD voltage. The VDD voltage may be greater than the HVDD voltage. A driving voltage from the second amplifier may be selected from a VSS voltage and the HVDD voltage, and the HVDD voltage may be greater than the VSS voltage.

The reference voltage may be the HVDD voltage, and the control switch may be connected to a portion of the common line located between (i) a first node where the first charge share switch and the common line are connected and (ii) a second node where the second charge share switch and the common line are connected.

The predetermined voltage may be greater than the VSS voltage and less than the HVDD voltage.

According to one or more other embodiments of the present invention, a display apparatus includes a display panel including gate lines, data lines, and pixels connected to the gate lines and the data lines, the pixels being in a matrix including rows and columns, a data driver configured to drive the data lines, and a gate driver configured to drive the gate lines.

It is to be understood that both the foregoing general description and the following detailed description of various embodiments of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
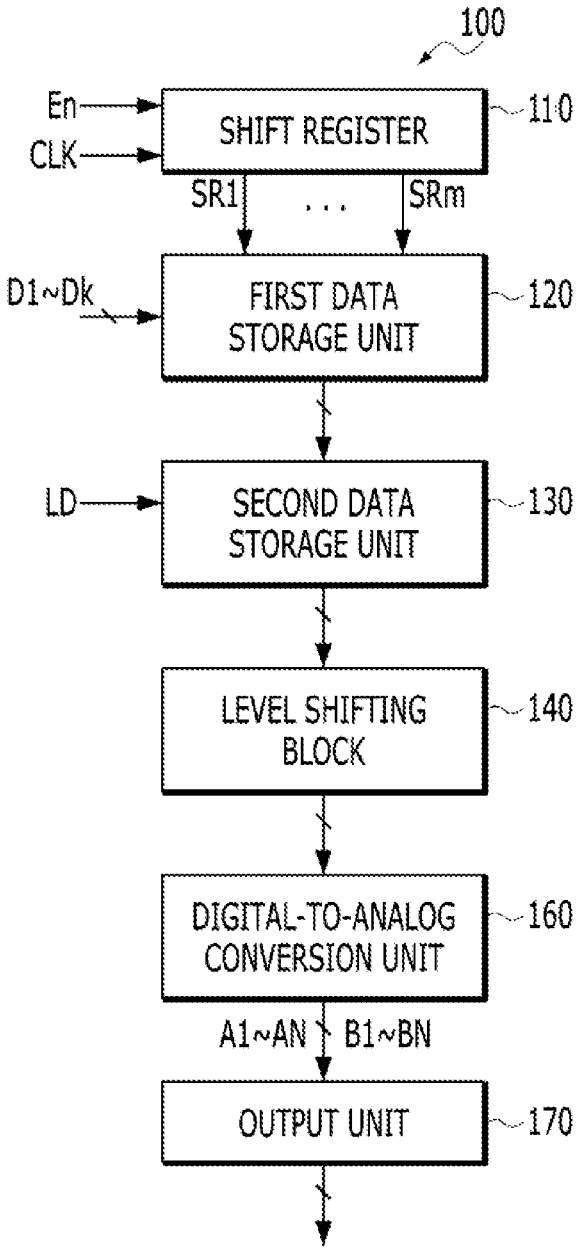
FIG. 1 is a diagram showing the configuration of an exemplary source driver according to one or more embodiments of the present invention.

Reference will now be made in detail to embodiments of the present invention, examples of which are illustrated in the accompanying drawings. In description of the various embodiments, it will be understood that, when an element such as a layer (film), region, pattern or structure is referred to as being formed "on" or "under" another element, such as a substrate, layer (film), region, pad or pattern, it can be directly "on" or "under" the other element or be indirectly on or under the other element with one or more intervening elements therebetween. It will also be understood that "on" and "under" the element is described relative to the drawings.

In addition, in the drawings, for example, sizes and thicknesses of constituent elements of an apparatus may be exaggerated for convenience and clarity of description. In addition, the sizes of the constituent elements are not necessarily to scale. The same reference numbers will be used throughout the specification to refer to the same or like constituent elements.

Figure 2:
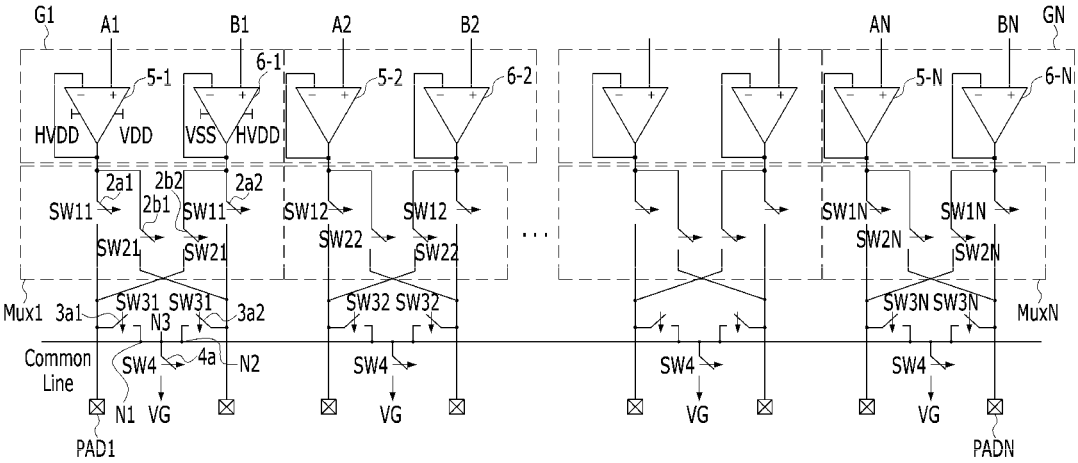
FIG. 2 is a diagram showing an exemplary output unit of FIG. 1.

FIG. 1 is a block diagram of an exemplary source driver 100 according to one or more embodiments, and FIG. 2 is a diagram showing one or more embodiments of the output unit 170 of FIG. 1.

Referring to FIGS. 1 and 2, the source driver 100 includes a shift register 110, a first data storage unit 120, a second data storage unit 130, a level shifting block 140, a digital-to-analog conversion unit 160 and an output unit 170. The source driver 100 may be replaced with a data driver.

The shift register 110 generates shift signals SR1 to SRm (m being a natural number greater than 1) in response to an enable signal En and a clock signal CLK to control timing when data (e.g., digital image data) is sequentially stored in the first data storage unit 120.

For example, the shift register 110 may receive a horizontal start signal from a controller 205 (see FIG. 6) and shift the received horizontal start signal in response to the clock signal CLK, thereby generating the shift signals SR1 to SRm (m being a natural number greater than 1). The horizontal start signal may be used interchangeably with a start pulse.

Figure 6:
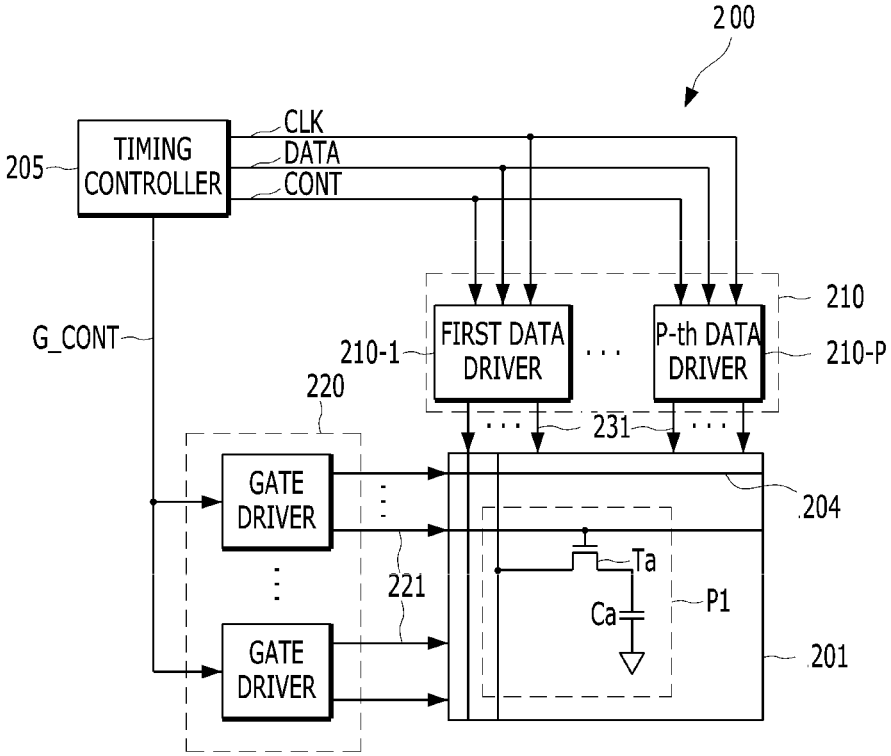
FIG. 6 is a diagram showing an exemplary display apparatus including a source driver according to one or more embodiments.

The first data storage unit 120 stores data D1 to Dk received from the controller 205 of FIG. 6 in response to the shift signals SR1 to SRm (m being a natural number greater than 1) generated by the shift register 110.

The first data storage unit 120 may include a plurality of first latches.

The second data storage unit 130 stores a data signal from the first data storage unit 120 in response to a first control signal LD. For example, the second data storage unit 130 may store the data signal from the first data storage unit 120 in units of a horizontal line period.

For example, the horizontal line period may refer to a period necessary to store all the data signals corresponding to a horizontal line or row 204 (FIG. 6) of the display panel 201 in the first latches of the first data storage unit 120 (FIG. 1).

The second data storage unit 130 may include a plurality of second latches corresponding to the plurality of first latches. For example, the number of second latches may be equal to the number of first latches, without being limited thereto. For example, the plurality of second latches may store data signals received from the plurality of first latches in response to the first control signal LD.

The level shifting block 140 converts the voltage levels of the data signals received from the second data storage unit 130. The level shifting block 140 may include a plurality of level shifters.

Each of the plurality of level shifters may correspond to one of the plurality of second latches.

Each of the plurality of level shifters converts the voltage level of the data signals from the second latches. In addition, each of the plurality of level shifters outputs level-shifted data signals (e.g., having converted voltage levels) and inverted level-shifted data signals.

For example, each of the plurality of level shifters may convert the levels of the data signal and an inverted data signal. In addition, each of the plurality of level shifters may output the level-shifted data signal and the inverted level-shifted data signal based on or according to the voltage level conversion.

The digital-to-analog conversion unit 160 converts the digital outputs of the level shifting block 140 into analog signals A1 to AN and B1 to BN (N being a natural number greater than 1). For example, the digital-to-analog conversion unit 160 may include analog-to-digital converters configured to convert the outputs of the level shifters of the level shifting block 140 to analog signals. Furthermore, the analog signals A1~AN and B1~BN may be differential signals (e.g., A1/B1, A2/B2, . . . AN/BN).

The digital-to-analog conversion unit 160 may include a plurality of digital-to-analog converters corresponding to the plurality of level shifters.

In addition, the digital-to-analog conversion unit 160 may convert a digital level-shifted data signal into a first analog signal (or the true part of a differential analog signal) and convert a digital inverted level-shifted data signal into a second analog signal (or the complementary part of the differential analog signal).

The output unit 170 receives the analog signals A1 to AN and B1 to BN from the digital-to-analog conversion unit 160, amplifies and/or buffers the received analog signals A1 to AN and B1 to BN, and outputs the amplified and/or buffered analog signal(s).

For example, the output unit 170 may include a plurality of amplifiers and/or a plurality of buffers corresponding to analog signals A1 to AN and B1 to BN from the digital-to-analog conversion unit 160.

The source driver 100 according to various embodiments may include pads PAD1 to PADN (N being a natural number greater than 1; see FIG. 2) or output terminals configured to output the amplified and/or buffered analog signals from the output unit 170.

Referring to FIG. 2, the output unit 170 may include a plurality of amplifiers 5-1 to 5-N and 6-1 to 6-N (N being a natural number greater than 1), a plurality of multiplexers MUX1 to MUXN (N being a natural number greater than 1), charge share switch pairs 3*a*1 and 3*a*2, a common line and a control switch 4*a*.

Each of the plurality of amplifiers 5-1 to 5-N (N being a natural number greater than 1) may correspond to a corresponding one of the analog signals A1 to AN, and each of the plurality of amplifiers 6-1 to 6-N may correspond to a corresponding one of the analog signals B1 to BN.

For example, each of the plurality of amplifiers 5-1 to 5-N and 6-1 to 6-N (N being a natural number greater than 1) may include a differential amplifier and/or a buffer.

For example, the plurality of amplifiers 5-1 to 5-N (N being a natural number greater than 1) may include first amplifiers 5-1 to 5-N, and the plurality of amplifiers 6-1 to 6-N may include second amplifiers 6-1 to 6-N.

In addition, the output unit 170 may include an amplification unit including amplifiers divided into a plurality of groups of amplifiers G1 to GN (N being a natural number greater than 1).

Each of the plurality of groups of amplifiers G1 to GN may include a first amplifier (e.g., the first amplifier 5-1) and a second amplifier (e.g., the second amplifier 6-1).

A first voltage VDD and a second voltage HVDD may be provided to each of the first amplifiers 5-1 to 5-N as a power supply voltage, a driving voltage, or a bias voltage.

The first voltage VDD may be greater than the second voltage HVDD (e.g., VDD>HVDD). For example, the second voltage HVDD may be half of the first voltage VDD, without being limited thereto.

In addition, the second voltage HVDD and a third voltage VSS may be provided to each of the second amplifiers 6-1 to 6-N as a power supply voltage, a driving voltage, or a bias voltage. The second voltage HVDD may be greater than the third voltage VSS (e.g., HVDD>VSS). The third voltage VSS may be a ground voltage.

In various embodiments, the first amplifiers 5-1 to 5-N may be positive amplifiers (or positive buffers) and the second amplifiers 6-1 to 6-N may be negative amplifiers (or negative buffers).

The multiplexers MUX1 to MUXN may select one of the outputs from a corresponding pair of amplifiers 5-1 and 6-1 to 5-N and 6-N, and provide the output of the selected amplifier to a corresponding one of a plurality of data lines.

For example, the multiplexers MUX1 to MUXN may select one of the outputs of the amplifier 5-1/6-1 to 5-N/6-N, and provide the output of the selected amplifier to a corresponding one of the pads PAD1 to PADN.

The pads PAD1 to PADN may be electrically connected to the corresponding data lines of the plurality of data lines 231 of the panel 201 (FIG. 6).

The multiplexers MUX1 to MUXN may selectively provide the outputs of the neighboring first and second amplifiers A1 and B1 to two neighboring pads (e.g., PAD1 and PAD2) of the pads PAD1 to PADN and/or two neighboring data lines, based on or in response to control signals SW11 to SW1N and SW21 to SW2N.

Each of the multiplexers MUX1 to MUXN may correspond to one of the groups of amplifiers G1 to GN of the output unit 170.

For example, each of the multiplexers MUX1 to MUXN may receive the outputs of two neighboring amplifiers (e.g., AN and BN) belonging to a corresponding group of amplifiers, and selectively provide the outputs from the two neighboring amplifiers to two neighboring pads (e.g., PAD1 and PAD2) of the pads PAD1 to PADN and/or two neighboring data lines.

The multiplexers MUX1 to MUXN and the amplifiers 5-1 to 5-N and 6-1 to 6-N may perform the inversion process or operation (e.g., a dot inversion, a line inversion, etc.) with respect to the panel 201.

For example, each of the multiplexers MUX1 to MUX1 may include a first switch 2a1, a second switch 2a2, a third switch 2b1, and a fourth switch 2b2.

The first switch 2a1 may be between the output terminal of one of the two neighboring amplifiers (e.g., 5-1 or 6-1) and one of the two neighboring pads (e.g., PAD1 or PAD2), and may be turned on or off by a first switch control signal (e.g., SW11).

The second switch 2a2 may be between the other of the two neighboring amplifiers (e.g., 5-1 or 6-1) and the other of the two neighboring pads (e.g., PAD1 or PAD2), and may be turned on or off by the first switch control signal (e.g., SW11).

The third switch 2b1 may be between the output terminal of one of the two neighboring amplifiers (e.g., 5-1 or 6-1) and the other of the two neighboring pads (e.g., PAD1 or PAD2), and may be turned on or off by a second switch control signal (e.g., SW21).

The third switch 2b2 may be between the output terminal of the other of the two neighboring amplifiers (e.g., 5-1 or 6-1) and one of the two neighboring pads (e.g., PAD1 or PAD2), and may be turned on or off by the second switch control signal (e.g., SW21).

The first switch control signals SW11 to SW1N and the second switch control signals SW21 to SW2N may be generated based on or in response to a polarity control signal POL (not shown). Here, the polarity control signal may be a control signal related to the inversion process or operation of the panel 201 (FIG. 6) and may be generated in a controller 205.

In addition, the first switch control signals SW11 to SW1N and the second switch control signals SW21 to SW2N may have opposite phases.

For example, the third and fourth switches 2b1 and 2b1 may be turned off when the first and second switches 2a1 and 2a2 are turned on, and the third and fourth switches 2b1 and 2b1 may be turned on when the first and second switches 2a1 and 2a2 are turned off.

Figure 4:
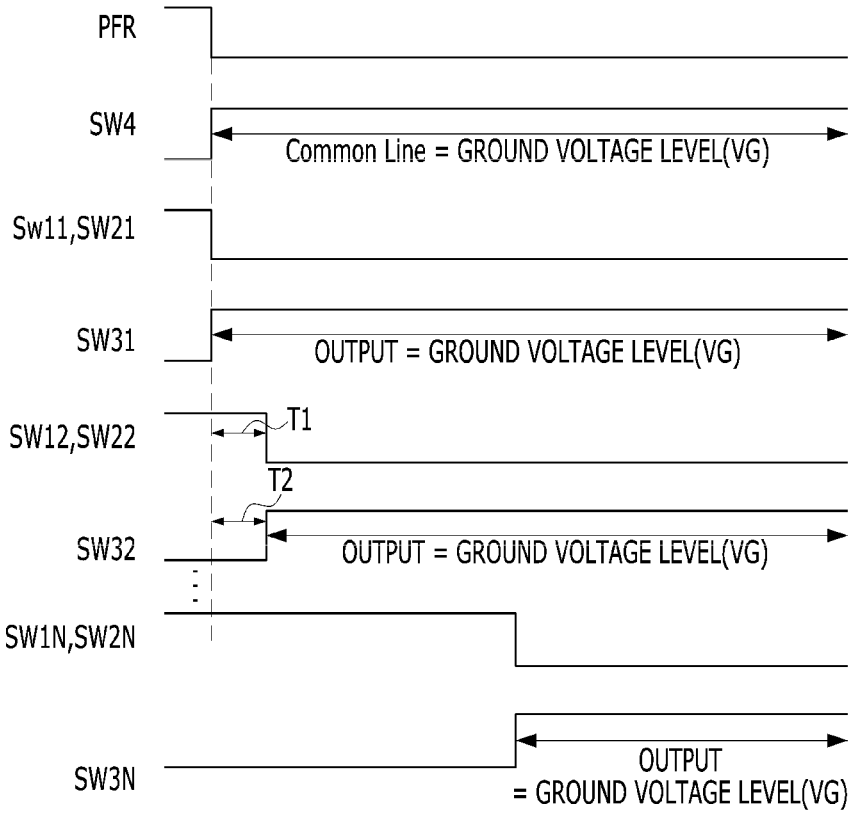
FIG. 4 is a timing chart illustrating exemplary first switch control signals, exemplary second switch control signals, exemplary charge share control signals and an exemplary control switch signal according to one or more embodiments.

In addition, as shown in FIG. 4, the multiplexers MUX1 to MUXN of FIG. 2 corresponding to the groups of amplifiers G1 to GN of FIG. 2 may sequentially perform multiplexing operations in order to reduce electromagnetic noise or interference. That is, the switches 2a1, 2a2, 2b1 and 2b2 of the multiplexers MUX1 to MUXN may sequentially perform a switching process or operation.

The first switch control signals SW11 to SW1N corresponding to the groups of amplifiers G1 to GN may have a predetermined time difference or time delay T1 (e.g., between successive signals SW11 to SW1N), and the second switch control signals SW21 to SW2N corresponding to the groups of amplifiers G1 to GN may have a predetermined time difference or time delay T1 (e.g., between successive signals SW21 to SW2N).

The source driver 100 may include charge share switches 3a1 and 3a2 corresponding to the multiplexers MUX1 to MUXN. For example, the number of charge share switch pairs 3a1 and 3a2 may be equal to the number of multiplexers MUX1 to MUXN, without being limited thereto.

The charge share switches 3a1 and 3a2 connect the pads PAD1 to PADN, to which the outputs of the multiplexers MUX1 to MUXN respectively corresponding to the groups of amplifiers G1 to GN are provided, to the common line, based on or in response to the corresponding charge share control signals SW31 to SW3N.

For example, each charge share switch pair or unit may include a first charge share switch 3a1 and a second charge share switch 3a2. Each of the first and second charge share switches 3a1 and 3a2 may be between a corresponding data line connected to the corresponding multiplexer and the common line.

The first charge share switch 3a1 may be between one of two neighboring pads (e.g., PAD1 or PAD2) and the common line, and may be turned on or off based on or in response to the corresponding charge share switch control signal (e.g., SW31).

The second charge share switch 3a2 may be between the other of the two neighboring pads (e.g., PAD1 or PAD2) and the common line, and may be turned on or off based on or in response to the same charge share switch control signal (e.g., SW31).

As shown in FIG. 4, the charge share switch pairs or units corresponding to the groups of amplifiers G1 to GN in FIG. 2 may sequentially perform charge sharing operations in order to reduce electromagnetic noise or interference.

For example, the charge share switch control signals SW31 to SW3N corresponding to the groups of amplifiers G1 to GN of FIG. 2 may have a predetermined time difference or time delay T2. Time delays T1 and T2 may be equal to or different from each other.

The common line may be connected to the pads PAD1 to PADN or the data lines through the charge share switch pairs 3a1 and 3a2 electrically, and the common line may float or be electrically disconnected from the pads PAD1 to PADN or the data lines when the charge share switches 3a1 and 3a2 are turned off. In one or more other embodiments, a predetermined voltage may be provided to the common line.

The control switch 4a may be between the common line and a power source configured to supply a reference voltage VG, and may be turned on or off based on or in response to a control switch signal SW4.

The reference voltage VG may be less than or equal to the first voltage VDD and/or greater than or equal to the third voltage VSS (e.g., VSS≤VG≤VDD), without being limited thereto.

Alternatively, the reference voltage VG may be greater than the third voltage VSS and may be less than or equal to the second voltage HVDD (e.g., VSS<VG≤HVDD).

Alternatively, the reference voltage VG may have a level of (e.g., be the same as) the second voltage HVDD or a ground voltage.

In various embodiments, the source driver 100 may include a plurality of control switches, and each of the plurality of control switches may correspond to one of the groups of amplifiers G1 to GN of the output unit 170. For example, the source driver 100 may include the plurality of control switches corresponding to the multiplexers Mux1 to MuxN of FIG. 2.

The control switch 4a may be connected to a region or part N3 of the common line between a first node N1 to which the first charge share switch 3a1 is connected and a second node N2 to which the second charge share switch 3a2 is connected.

This provides a uniform or equal voltage to the pads (e.g., PAD1 and PAD2) by the reference voltage VG by making the lengths of the paths between the region or part N3 of the common line and the pads (e.g., PAD1 and PAD2) the same or substantially the same.

A control switch signal SW4 may be generated based on or in response to a power off reset (PFR) signal or a power on reset (POR) signal.

Figure 3A:
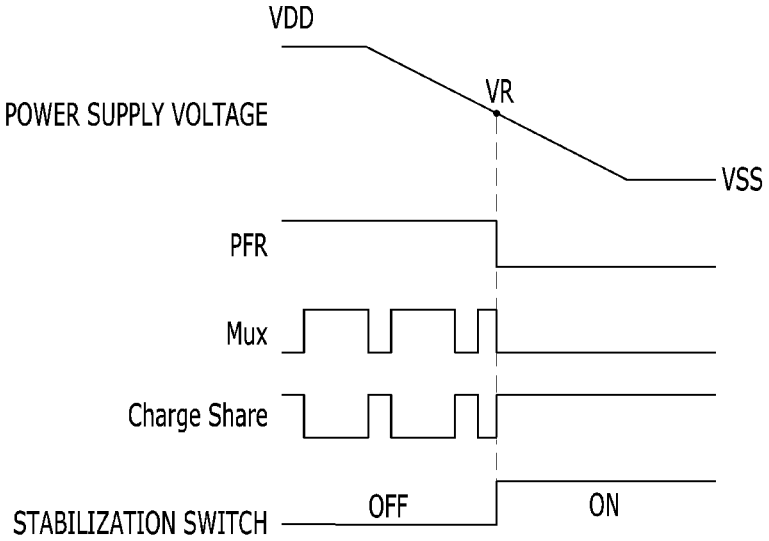
FIG. 3A is a timing chart illustrating an exemplary multiplexing operation of a multiplexer, charge sharing operation of a charge share switch unit and stabilization operation of a control switch according to a PFR signal.
Figure 3B:
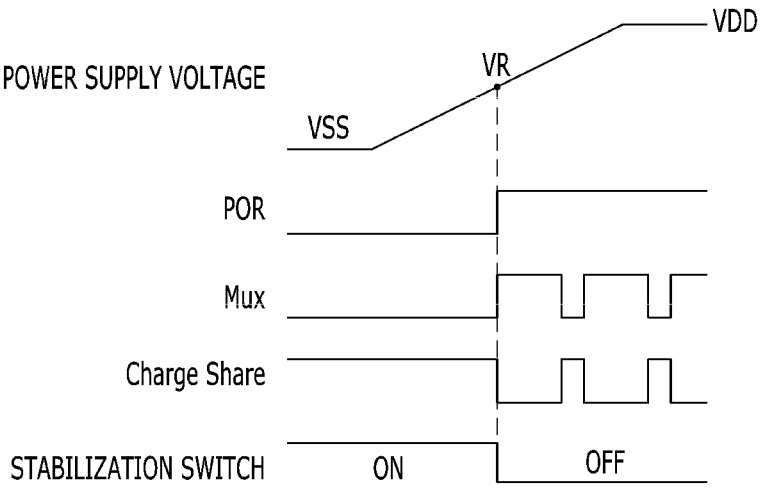
FIG. 3B is a timing chart illustrating an exemplary multiplexing operation of the multiplexer, an exemplary charge sharing operation of the charge share switch unit, and an exemplary stabilization operation of the control switch based on or in response to a power on reset (POR) signal.

The PFR signal may be generated in response to or based on turning off the power supply (e.g., the power supply decreasing below a first threshold voltage), and the POR signal (not shown) may be generated in response to or based on turning on the power supply (e.g., the power supply increasing above a second threshold voltage), as shown in FIGS. 3A-B. The power supply voltage may be provided to a source driver or the amplification unit (e.g., the first and second amplifiers 5-1 to 5-N and 6-1 to 6-N).

When the power supply voltage VDD supplied to the source driver 100 is less than a predetermined voltage VR (e.g., see FIGS. 3A and 3B) when the power to the source driver 100 is on or off, the control switch 4*a* is turned on. When the control switch 4*a* is turned on, the reference voltage VG may be provided to the common line, and the outputs of the source driver 100 may become the reference voltage VG, thereby stabilizing the image of the panel 201. This may be referred to as a stabilization process or operation of the source driver 100 by the control switch signal SW4 when the power is on or off.

For example, the control switch 4*a* may be replaced with a "stabilization switch" or a "garbage switch".

FIG. 3A is a timing chart showing an exemplary multiplexing process or operation of the multiplexer MUX, a charge share process or operation of the charge share switch pair 3*a*1 and 3*a*2, and a stabilization process or operation of the control switch 4*a* based on or in response to the PFR signal.

Referring to FIG. 3A, when the power is turned off, the source driver 100 may include a power off sensing unit (not shown) configured to sense the level of the power supply voltage provided to the source driver 100 and generate a PFR signal based on or in response to the sensed level of the power supply voltage.

The power off sensing unit may be included in the controller 205 of the source driver 100.

Figure 5:
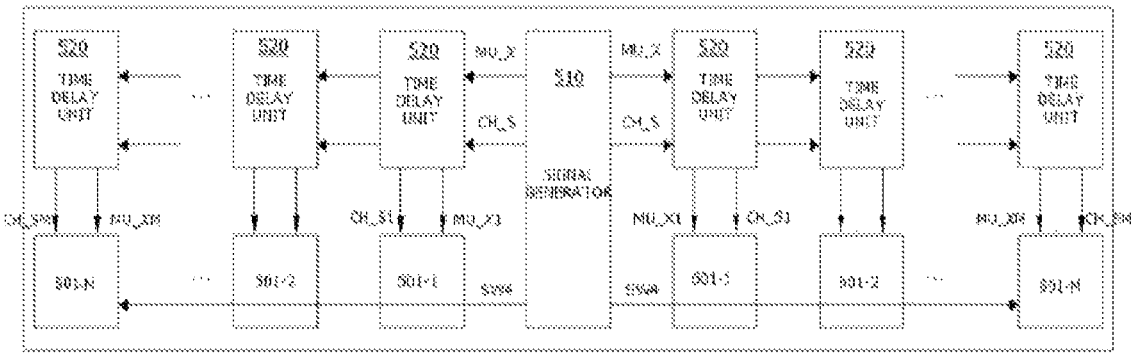
FIG. 5 is a diagram showing an example of output terminals of an exemplary output unit configured to reduce electromagnetic interference.

For example, the power off sensing unit may be included in a signal generator 510, as shown in FIG. 5.

For example, when the power to the source driver 100 (or the amplification unit) is turned off, the power supply voltage provided to the source driver 100 (or the amplification unit) may decrease from the first voltage VDD to the third voltage VSS. The power off sensing unit of the controller 205 may compare the sensed level of the power supply voltage with the predetermined voltage VR and generate a PFR signal based on or in response to the comparison of the sensed power supply voltage and the predetermined voltage VR.

For example, when the level of the voltage sensed by the power off sensing unit of the controller 205 is less than the predetermined voltage VR, the PFR signal may have a first level (e.g., a "low level").

When the level of the voltage sensed by the power off sensing unit of the controller 205 is greater than the predetermined voltage VR, the PFR signal may have a second level (e.g., a "high level") different from or higher than the first level.

Based on or in response to a transition of the PFR signal, the control switch 4*a* may turn on to provide the reference voltage to the common line. Based on or in response to the PFR signal, the charge share switch pair may turn on, and the multiplexers may turn off.

For example, when the PFR signal has the first level, the switches 2*a*1, 2*a*2, 2*b*1 and 2*b*2 of the multiplexers Mux1 to MuxN (N being a natural number greater than 1) may be turned off, the charge share switch pair 3*a*1 and 3*a*2 may be turned on, and the control switch 4*a* may be turned on.

FIG. 3B is a timing chart showing an exemplary multiplexing process or operation of the multiplexer MUX, an exemplary charge share process or operation of the charge share switch pair 3*a*1 and 3*a*2, and an exemplary stabilization process or operation of the control switch 4*a* based on or in response to the POR signal.

Referring to FIG. 3B, when the power is turned on, the source driver 100 may include a power on sensing unit (not shown) configured to sense the level of the power supply voltage provided to the source driver 100 and generate a POR signal based on or in response to the sensed level of the power supply voltage. The power on sensing unit may be included in the controller 205 of the source driver 100. For example, the power on sensing unit may be included in the signal generator 510, as shown in FIG. 5.

For example, when the power to the source driver 100 (or the amplification unit) is turned on, the power supply voltage provided to the source driver 100 (or the amplification unit) may increase from the third voltage VSS to the first voltage VDD. The power on sensing unit of the controller 205 may compare the sensed level of the power supply voltage with the predetermined voltage VR and generate a POR signal POR based on or in response to the comparison of the sensed power supply voltage and the predetermined voltage VR.

For example, when the level of the voltage sensed by the power on sensing unit of the controller 205 is less than the predetermined voltage VR, the POR signal may have a first level (e.g., a "low level").

In contrast, when the level of the voltage sensed by the power on sensing unit of the controller 205 is greater than the predetermined voltage VR, the POR signal may have a second level (e.g., a "high level"). In various examples, the power off sensing unit and the power on sensing unit may be the same circuit or different circuits.

Based on or in response to the POR signal, the control switch 4*a* may be turned on to provide the reference voltage VG to the common line. Based on or in response to the POR signal, the charge share switch pairs may turn on, and the multiplexers may turn off.

For example, when the POR signal has a first level, the switches 2*a*1, 2*a*2, 2*b*1 and 2*b*2 of the multiplexers may be turned off, the charge share switch pair 3*a*1 and 3*a*2 may be turned on, and the control switch 4*a* may be turned on.

The power supply voltage to the source driver 100 related to the PFR signal and/or the POR signal may include one or more power supply voltages provided to the components of the source driver 100 (for example, the output unit 170, the digital-to-analog conversion unit 160, the level shifting block 140, and the data storage units 120 and 130).

In addition, the signals (e.g., the PFR and POR signals) generated from the power supply voltage and the other signals of the source driver 100 may be combined to turn on or turn off the source driver 100.

FIG. 4 is a timing chart of the exemplary first switch control signals SW11 to SW1N, the exemplary second switch control signals SW21 to SW2N, the exemplary charge share control signals SW31 to SW3N and the exemplary control switch signal SW4 according to various embodiments.

Although the timing chart according to the PFR signal is shown in FIG. 4, the present invention is not limited thereto, and the POR signal may be used instead of the PFR signal.

Referring to FIG. 4, when the source driver 100 is normally driven, the control switch 4*a* is off and the reference voltage VG does not influence the common line. For example, the source driver 100 is normally driven when the PFR signal has the second level (e.g., a high level).

In contrast, in a stabilization process or operation period in which the PFR signal has the first level (e.g., a low level), the control switch 4*a* is on, the switches 2*a*1, 2*a*2, 2*b*1 and 2*b*2 of the multiplexers MUX1 to MUXN are off, and the charge switch pairs 3*a*1 and 3*a*2 are on.

In the stabilization process or operation period, the voltage on the common line may be the reference voltage VG as a result of the control switch 4*a* being on, and the voltages of the pads PAD1 to PADN and/or the voltages of the data lines may be the reference voltage VG as a result of the charge share switch pairs 3*a*1 and 3*a*2 being on, thereby stabilizing the outputs of the source driver 100.

During the stabilization process or operation of the source driver 100, when the PFR signal has the first level (e.g., the low level), the multiplexers MUX1 to MUXN may be sequentially turned off with a predetermined time delay difference (e.g., between successive multiplexers), and the charge share switch pairs may be sequentially turned on in synchronization with turning-off a corresponding one of the multiplexers MUX1 to MUXN.

When the multiplexers MUX1 to MUXN are sequentially turned off, the charge share switch pairs corresponding to the multiplexers MUX1 to MUXN may be sequentially turned on.

Each of the multiplexers MUX1 to MUXN may include a plurality of switches 2*a*1, 2*a*2, 2*b*1 and 2*b*2, and the switches 2*a*1, 2*a*2, 2*b*1 and 2*b*2 may selectively output the data signals from the first and second amplifiers 5-1 and 6-1 to 5-N and 6-N of a corresponding one of the plurality of groups of amplifiers G1 to GN to two neighboring or adjacent data lines of the plurality of data lines.

The switches 2*a*1, 2*a*2, 2*b*1 and 2*b*2 of the multiplexers MUX1 to MUXN may be turned off by the PFR signal having the first level.

FIG. 5 is a diagram showing an example of exemplary output terminals 501-1 to 501-M and 601-1 to 601-M of the output unit 170 and associated control circuitry configured to reduce electromagnetic interference (e.g., on or from the output terminals).

Referring to FIG. 5, the source driver 100 of FIG. 1 may further include a signal generator 510 and time delay units 520.

For example, the output unit 170 may include a plurality of output terminals 501-1 to 501-M and 601-1 to 601-M (M being a natural number greater than 1 and less than N).

The plurality of output terminals 501-1 to 501-M and 601-1 to 601-M (M being a natural number greater than 1 and less than N) may correspond to the plurality of groups of amplifiers G1 to GN. For example, N=2M, without being limited thereto.

Each of the output terminals 501-1 to 501-M and 601-1 to 601-M (M being a natural number greater than 1 and less than N) may include a multiplexer, charge share switch pair 3*a*1 and 3*a*2, and control switch 4*a*.

The signal generator 510 may generate a multiplexer signal MU_X configured to control the multiplexers MUX1 to MUXN, a charge share signal CH_S configured to control the charge control switches 2*a*1, 2*a*2, 2*b*1 and 2*b*2, and a control switch signal SW4 configured to control the control switch 4*a*.

The multiplexer signal MU_X may include switch control signals configured to control the switches 2*a*1, 2*a*2, 2*b*1 and 2*b*2 of the multiplexers.

In addition, the charge share signal CH_S may include charge share control signals configured to control the charge share switch pairs 3*a*1 and 3*a*2.

The time delay units 520 may receive the multiplexer signal MU_X and sequentially delay the received multiplexer signal by a predetermined time, thereby generating the switch control signals MU_X1 to MU_XM configured to sequentially drive or activate the multiplexers MUX1 to MUXN.

In addition, the time delay units 510 may receive the charge share signal CH_S and sequentially delay the received charge share signal CH_S by a predetermined time, thereby generating the charge share signals CH_S1 to CH_SM configured to sequentially drive or activate the charge share switch pairs 3*a*1 and 3*a*2.

The signal generator 520 may be located in a center of the output terminals (which may be in a 1×2M row, such that the multiplexer signal MU_X and the charge share signal CH_S are sent from the signal generator 510 to equidistant the time delay units on opposite sides of the signal generator 510 simultaneously or substantially simultaneously, and the time-delayed multiplexer and charge share signals are generated simultaneously or substantially simultaneously by the time delay units 520, as shown in FIG. 5. However, the present invention is not limited thereto.

The multiplexer signal MU_X and the charge share signal CH_S generated by the signal generator 510 may be time-delayed by successive time delay units 520 along one direction by increasing amounts, and the successively time-delayed multiplexer signals MU_X1 to MU_X4 and the successively time-delayed charge share signals CH_S1 to CH-S4, respectively generate the switch control signals SW11 to SW1N and SW21 to SW2N and the charge share control signals SW31 to SW3N shown in FIG. 2 and described with reference to FIG. 4.

For image stabilization, the general source driver may include a garbage switch connected to each pad. For example, in the conventional source driver, the common line of FIG. 2 is omitted, the charge share switch unit may be between two neighboring or adjacent pads, and the garbage switch may be connected to each pad.

In order to reduce electromagnetic noise or interference, in the conventional source driver, the switches of the multiplexers and the charge share switch unit sequentially operate, but the garbage switches connected to the pads may be simultaneously turned on in response to the PFR signal. Therefore, at least some of the multiplexers and the garbage switches may be simultaneously on. Since the garbage switches are connected to the pads, the output of the amplifier and the ground voltage provided to the garbage switch are instantaneously connected through the garbage switches and the switches of the multiplexers which are simultaneously turned on in the stabilization process or operation, thereby generating overcurrent in the source driver chip and damaging the source driver.

However, the source driver 100 according to embodiments of the present invention includes the charge share switch pairs 3*a*1 and 3*a*2 and the control switch 4*a* connected to the common line.

As shown in FIG. 4, the control switches 4*a* corresponding to the groups of amplifiers G1 to GN of the output unit 170 are simultaneously turned on in response to the control switch signal SW4. In addition, since the charge share switch pairs 3*a*1 and 3*a*2 are sequentially turned on in synchronization with sequentially turning off the switches of the multiplexers of the groups of amplifiers G1 to GN by the control signals SW11 to SW1N and SW21 to SW2N and the charge share control signals SW31 to SW3N, an electrical path is not formed between (i) the output terminals of the amplifiers 5-1 and 6-1 to 5-N and 6-N and (ii) the reference voltage during the stabilization process or operation, thereby preventing overcurrent from occurring during the stabilization process or operation.

As described above, according to various embodiments of the present invention, at the time of a PFR process or operation, it is possible to prevent overcurrent from flowing in the source driver 100 and to stabilize the image of the panel 200 when power to the display device is turned on or off.

FIG. 6 is a diagram showing an exemplary display apparatus 200 including a source driver 100 according to embodiments of the present invention.

Referring to FIG. 6, the display apparatus 200 includes a display panel 201, a controller 205 (or timing controller), a source driver unit 210 and a gate driver unit 220.

The display panel 201 includes gate lines 221 forming rows and data lines 231 forming columns, both of which cross each other to form a matrix, and pixels P1 connected to the gate lines and data lines at locations where they cross each other. A plurality of pixels P1 may be provided, and each pixel P1 may include a transistor Ta and a capacitor Ca.

The controller 205 outputs a clock signal CLK, data DATA, a data control signal CONT configured to control the source driver 210, and a control signal G_CONT configured to control the gate driver unit 220.

For example, the control signal CONT may include a horizontal start signal, a first control signal LD, an enable signal En and a clock signal CLK that is input to the shift register 110 (see FIG. 1) of the source driver 200.

The gate driver unit 220 may drive the gate lines 221, include a plurality of gate drivers, and output gate control signals configured to control the transistors Ta of the pixels to the gate lines.

The source driver unit 210 may drive the data lines 231 and include a plurality of data drivers 210-1 to 210-P (P being a natural number greater than 1).

Each of the source drivers 210-1 to 210-P (P being a natural number greater than 1) may be or comprise a source driver the various 100, as shown in FIG. 1.

In the display apparatus 200, according to various embodiments, since it is possible to improve the digital-to-analog conversion speed of the digital-to-analog converter of the source driver, high-resolution image quality can be implemented.

According to various embodiments, it is possible to prevent overcurrent during a power off reset (PFR) process or operation and to stabilize an image of a panel when the power supply is turned on or off.

Characteristics, structures, effects, and so on described in the above embodiments are included in at least one of the embodiments, but are not limited to only one embodiment. Furthermore, it is apparent that the features, structures, effects, and so on described in various embodiments may be combined or modified with other embodiments by persons skilled in the art. Therefore, it should be understood that the contents relevant to such combination and modification fall within the scope of the present invention.

What is claimed is:

1. A source driver comprising:

an amplification unit including a plurality of groups of amplifiers, each of the plurality of groups of amplifiers including a first amplifier and a second amplifier;

multiplexers configured to select and provide an output of one of the first and second amplifiers in each of the plurality of groups of amplifiers to one of a plurality of data lines;

charge share switch units corresponding to the multiplexers and between the plurality of data lines and a common line; and a control switch between the common line and a power supply configured to provide a reference voltage, wherein based on or in response to a power off reset (PFR) signal, the control switch provides the reference voltage to the common line, and the charge share switches connect the common line to the data lines.

2. The source driver according to claim 1, wherein:

when a voltage of the power supply to the amplification unit becomes less than a predetermined voltage, the PFR signal has a first level, the control switch is turned on by the PFR signal having the first level, the charge share switch units are turned on by the PFR signal having the first level, and each of the multiplexers is turned off by the PFR signal having the first level.

3. The source driver according to claim 2, wherein:

the multiplexers are sequentially turned off with a predetermined time difference, and the charge share switch units are sequentially turned on in synchronization with turning off a corresponding one of the multiplexers.

4. The source driver according to claim 3, wherein:

each of the charge share switch units includes first and second charge share switches respectively corresponding to the multiplexers, and each of the first and second charge share switches is between a corresponding one of two data lines and the common line, and the two data lines are connected to the corresponding multiplexer.

5. The source driver according to claim 4, wherein the control switch is connected to a part or region of the common line between (i) a first node where the first charge share switch and the common line are connected and (ii) a second node where the second charge share switch and the common line are connected.

6. The source driver according to claim 4, wherein the control switch includes control switches corresponding to the multiplexers.

7. The source driver according to claim 3, wherein:

each of the multiplexers includes a plurality of switches, and the switches in each of the multiplexers selectively output a data signal from the first and second amplifiers of a corresponding one of the plurality of groups of amplifiers to two neighboring or adjacent data lines of the plurality of data lines.

8. The source driver according to claim 7, wherein the switches in each of the multiplexers are turned off by the PFR signal having the first level.

9. The source driver according to claim 2, wherein:

the first amplifier has a first driving voltage selected from an HVDD voltage and a VDD voltage, the VDD voltage is greater than the HVDD voltage, the second amplifier has a second driving voltage selected from a VSS voltage and the HVDD voltage, and the HVDD voltage is greater than the VSS voltage.

10. The source driver according to claim 9, wherein the predetermined voltage is greater than the VSS voltage and less than the HVDD voltage.

11. The source driver according to claim 9, wherein the reference voltage is the HVDD voltage.

12. The source driver according to claim 2, wherein:

the multiplexers are sequentially turned off with a predetermined time difference, and each of the charge share switch units is turned on when a corresponding one of the multiplexers is turned off.

13. The source driver according to claim 2, further comprising a signal generator configured to sense a voltage level of the power supply and to generate the PFR signal having the first level when the sensed voltage level is less than the predetermined voltage.

14. A display apparatus comprising:

a display panel including gate lines, data lines and pixels connected to the gate lines and the data lines, the pixels being in a matrix including rows and columns;

a data driver configured to drive the data lines; and a gate driver configured to drive the gate lines, wherein the data driver is the source driver of claim 1.

15. A source driver comprising:

a plurality of amplifiers;

multiplexers configured to select and provide an output of one of the plurality of amplifiers to one of a plurality of data lines;

charge share switch units corresponding to the multiplexers and between the plurality of data lines and a common line; and a control switch between the common line and a power supply configured to provide a reference voltage, wherein:

the amplifiers are divided into a plurality of groups of amplifiers, and each of the plurality of groups of amplifiers includes a first amplifier and a second amplifier, each of the multiplexers selectively outputs a data signal from the first and second amplifiers of a corresponding one of the plurality of groups of amplifiers to two neighboring or adjacent data lines of the plurality of data lines, and when a voltage from the power supply to the amplifiers becomes less than a predetermined voltage, the control switch is turned on, the multiplexers are turned off, and the charge share switch units are turned on.

16. The source driver according to claim 15, wherein:

the multiplexers are sequentially turned off with a predetermined time difference, and the charge share switch units are sequentially turned on in synchronization with turning off a corresponding one of the multiplexers.

17. The source driver according to claim 16, wherein:

each of the charge share switch units includes first and second charge share switches respectively corresponding to the multiplexers, and each of the first and second charge share switches is between a corresponding one of two data lines connected to the corresponding multiplexer and the common line.

18. The source driver according to claim 17, wherein:

the first amplifier having a driving voltage selected from an HVDD voltage and a VDD voltage, the VDD voltage is greater than the HVDD voltage, the second amplifier has a driving voltage selected from a VSS voltage and the HVDD voltage, and the HVDD voltage is greater than the VSS voltage.

19. The source driver according to claim 18, wherein:

the reference voltage is the HVDD voltage, and the control switch is connected to a part or region of the common line between (i) a first node where the first charge share switch and the common line are connected and (ii) a second node where the second charge share switch and the common line are connected.

20. The source driver according to claim 19, wherein the predetermined voltage is greater than the VSS voltage and less than the HVDD voltage.

* * * * *